US009139948B2

(12) United States Patent
Wakizaka

(10) Patent No.: US 9,139,948 B2
(45) Date of Patent: Sep. 22, 2015

(54) HEAT PUMP TYPE CLOTHES DRYER WITH SECONDARY BLOWING MECHANISM

(75) Inventor: Eiji Wakizaka, Osakabu (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 852 days.

(21) Appl. No.: 13/314,568

(22) Filed: Dec. 8, 2011

(65) Prior Publication Data

US 2012/0144693 A1 Jun. 14, 2012

(30) Foreign Application Priority Data

Dec. 14, 2010 (JP) ..... 2010-278379

(51) Int. Cl.
*D06F 58/28* (2006.01)
*D06F 58/20* (2006.01)

(52) U.S. Cl.
CPC ..... *D06F 58/206* (2013.01); *D06F 58/28* (2013.01); *D06F 2058/287* (2013.01); *D06F 2058/2854* (2013.01); *D06F 2058/2864* (2013.01)

(58) Field of Classification Search
CPC . D06F 58/206; D06F 58/28; D06F 2058/287; F26B 21/086; F26B 21/06; F26B 23/005; Y02B 40/72
See application file for complete search history.

(56) References Cited

U.S. PATENT DOCUMENTS 3,064,358 A 11/1962 Giuffre
3,739,487 A 6/1973 Clark
5,456,022 A * 10/1995 McLeod et al. ..... 34/77
6,745,495 B1 * 6/2004 Riddle et al. ..... 34/497
7,448,145 B2 * 11/2008 Kim ..... 34/562
7,975,502 B2 * 7/2011 Tamura et al. ..... 34/210
8,312,640 B2 * 11/2012 Taniguchi et al. ..... 34/134
8,347,520 B2 * 1/2013 Kuwabara ..... 34/73
8,393,172 B2 * 3/2013 Sato et al. ..... 34/201
8,418,376 B2 * 4/2013 Steffens et al. ..... 34/72
2005/0204583 A1 9/2005 Kim (Continued)

FOREIGN PATENT DOCUMENTS

DE 10 2006 003 552 A1 5/2007
JP 2004-144433 5/2004

(Continued)

OTHER PUBLICATIONS

Extended European Search Report for related European Application No. 11192501.2, mailed May 3, 2012.
Japanese Office Action issued Jan. 15, 2015 in Japanese Patent Application No. 2010-278379.

*Primary Examiner* — David J Laux
(74) *Attorney, Agent, or Firm* — Staas & Halsey LLP

(57) ABSTRACT

A heat pump type clothes dryer compensates for pressure loss caused by a radiator to increase the flow rate of air passing around the radiator, and suppressing introduction of ambient air through gaps formed in air flow lines to avoid degradation in drying capacity, while avoiding an increase in the power consumption or noise of a fan. The clothes dryer includes a drum to accommodate clothes, an air suction or intake line to suck air into the drum, an air exhaust line to exhaust air from the drum, a heat pump circuit including a compressor, a radiator, a pressure reducer, and a heat absorber, where the heat absorber is provided in the air exhaust line, and the radiator is provided in the air suction or intake line, a first blowing mechanism provided in the air exhaust line, and a second blowing mechanism provided in the air suction or intake line.

9 Claims, 5 Drawing Sheets

(56) References Cited

U.S. PATENT DOCUMENTS

| | | | | |
|---|---|---|---|---|
| 2005/0217133 | A1* | 10/2005 | Yakumaru et al. | 34/134 |
| 2005/0246920 | A1* | 11/2005 | Yabuuchi et al. | 34/515 |
| 2007/0039198 | A1* | 2/2007 | Boettcher et al. | 34/131 |
| 2007/0169366 | A1* | 7/2007 | Tadano | 34/77 |
| 2010/0281707 | A1* | 11/2010 | Nawrot et al. | 34/134 |
| 2012/0017615 | A1* | 1/2012 | Beers et al. | 34/108 |

FOREIGN PATENT DOCUMENTS

| | | |
|---|---|---|
| JP | 2004-329755 | 11/2004 |
| JP | 2007-143631 | 6/2007 |
| JP | 2007-143720 | 6/2007 |
| JP | 2007-143735 | 6/2007 |
| JP | 2008-188147 | 8/2008 |
| JP | 2010-12073 | 1/2010 |
| JP | 2010-094206 | 4/2010 |

* cited by examiner

HEAT PUMP TYPE CLOTHES DRYER WITH SECONDARY BLOWING MECHANISM

CROSS-REFERENCE TO RELATED APPLICATIONS

This application claims the priority benefit of Japanese Patent Application No. 2010-278379 filed on Dec. 14, 2010 in the Japan Patent Office, the disclosure of which is incorporated herein by reference.

BACKGROUND

1. Field

Embodiments relate to a heat pump type clothes dryer.

2. Description of the Related Art

As an example of a conventional clothes dryer, Japanese Unexamined Patent Publication No. 61-22894 discloses a heat pump type dryer (see FIG. 1). In the disclosed heat pump type dryer, a condenser (radiator) is provided at an air suction or intake line, which sucks or intakes air into a drum. Also, a fan and a heat absorber (evaporator) are provided at an air exhaust line, through which air is exhausted from the drum. In accordance with this configuration, the heat pump type dryer recovers exhaust heat from the exhaust air, and heats the sucked or intake air using the recovered heat.

However, in the configuration in which the fan is installed at the air exhaust line, as mentioned above, the interior of the drum may be under a lower pressure than atmospheric pressure. As a result, ambient air is sucked into the drum through gaps formed in the lines. For example, air may be sucked between sliding parts of the drum, or through connecting portions of other elements, due to a pressure difference between the drum and the outside of the drum. In particular, in the heat pump type dryer mentioned above, the radiator provided at the air suction or intake line exhibits high flow resistance, so that suction or intake of ambient air through the gaps may be increased. Consequently, the flow rate of air passing around the radiator provided at the air suction or intake line is reduced. In a heat pump cycle, when the flow rate of air passing around a radiator is reduced, the pressure of refrigerant may be increased. Accordingly, when the flow rate of air passing around the radiator is reduced, it may be necessary to reduce heating capacity, and thus to reduce drying capacity.

In order to secure a required air flow rate for the radiator, the blowing rate of the fan installed at the air exhaust line may be increased. However, when the flow rate of exhaust air increases, the pressure loss of the air exhaust line may also be increased, because an air exhaust duct is connected to the dryer, as shown in FIG. 2. Generally, pressure loss is increased in proportion to the square of the air flow rate increase ratio, and air blowing power is increased in proportion to the cube of the air flow rate increase ratio. For this reason, there may be problems such as increased power consumption and increased noise of the fan.

SUMMARY

Therefore, it is an aspect of the embodiments to solve the above-mentioned problems and to provide a heat pump type clothes dryer, which is capable of compensating for pressure loss caused by a radiator to increase the flow rate of air passing around the radiator, and suppressing introduction of ambient air through gaps formed in air flow lines to avoid degradation in drying capacity, while avoiding an increase in the power consumption or noise of a fan.

Additional aspects of the embodiments will be set forth in part in the description which follows and, in part, will be obvious from the description, or may be learned by practice of the invention.

In accordance with one aspect of the embodiments, a clothes dryer includes a drum to accommodate clothes, an air suction or intake line to suck air into the drum, an air exhaust line to exhaust air from the drum, a heat pump circuit including a compressor, a radiator, a pressure reducer, and a heat absorber, where the heat absorber is provided in the air exhaust line, the radiator is provided in the air suction or intake line, a first blowing mechanism is provided in the air exhaust line, and a second blowing mechanism is provided in the air suction or intake line.

In accordance with this aspect, it may be possible to compensate for pressure loss of the radiator by the second blowing mechanism provided in the air suction or intake line. Accordingly, the flow rate of air passing around the radiator may be increased without an increase in the air blowing rate of the first blowing mechanism. Also, it may be possible to increase the internal pressure of the drum, as compared to the case in which only the first blowing mechanism is provided. Accordingly, it may be possible to reduce the amount of air introduced through gaps formed in the air flow lines, and thus to suppress an increase in the flow rate of exhaust air. As a result, it may be possible to avoid degradation in drying capacity, while avoiding an increase in the power consumption or noise of a fan.

In order to automatically cope with various situations through a control operation for an air blowing rate of the second blowing mechanism, the clothes dryer may further include a controller to control the air blowing rate of the second blowing mechanism.

In order to prevent the heat absorber from being frosted (frozen) due to a reduction in the refrigerant temperature thereof, and thus to achieve highly-efficient drying even under a low-temperature condition, the clothes dryer may further include a refrigerant temperature measurer to measure the refrigerant temperature of the heat absorber, and the controller may acquire a measurement signal from the refrigerant temperature measurer, and may reduce the air blowing rate of the second blowing mechanism when the refrigerant temperature of the heat absorber is not more than a predetermined temperature. Although the reduced air blowing rate of the second blowing mechanism under the low-temperature condition causes a reduction in the heat radiation amount of the radiator, there is no reduction in refrigerant temperature because the increase in the flow rate of air passing around the air absorber is slight. Accordingly, it may be possible to prevent the heat absorber from being frosted (frozen).

In order to prevent the temperature of the heat pump circuit from being excessively increased, the clothes dryer may further include a refrigerant pressure measurer to measure a refrigerant pressure of the radiator, and the controller may acquire a measurement signal from the refrigerant pressure measurer, and may maintain or increase the air blowing rate of the second blowing mechanism when the refrigerant pressure of the radiator is not less than a predetermined pressure.

As the air blowing rate of the second blowing mechanism is maintained or increased, the amount of radiated heat may be increased, so that the temperature of the heat pump circuit may be reduced.

Where a heater is arranged downstream of the radiator in the air suction or intake line, the controller may stop the heater when the radiator has a refrigerant pressure not less than a predetermined pressure causing the second blowing mechanism to have a maximum air blowing rate. In this case, the temperature of the heat pump circuit may be further reduced in accordance with the increased air blowing rate of the second blowing mechanism and the stopping of the heater.

It may be possible to reduce the amount of air introduced through gaps formed in the air flow lines by increasing the internal pressure of the drum through the second blowing mechanism. However, when the internal pressure of the drum exceeds atmospheric pressure, humid air from the drum is outwardly discharged. As a result, there may be formation of frost or formation of unpleasant conditions in an indoor space. To prevent this occurrence, the clothes dryer may further include a drum pressure measurer to measure the internal pressure of the drum, and the controller may control the second blowing mechanism such that the internal pressure of the drum is not more than a predetermined pressure.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
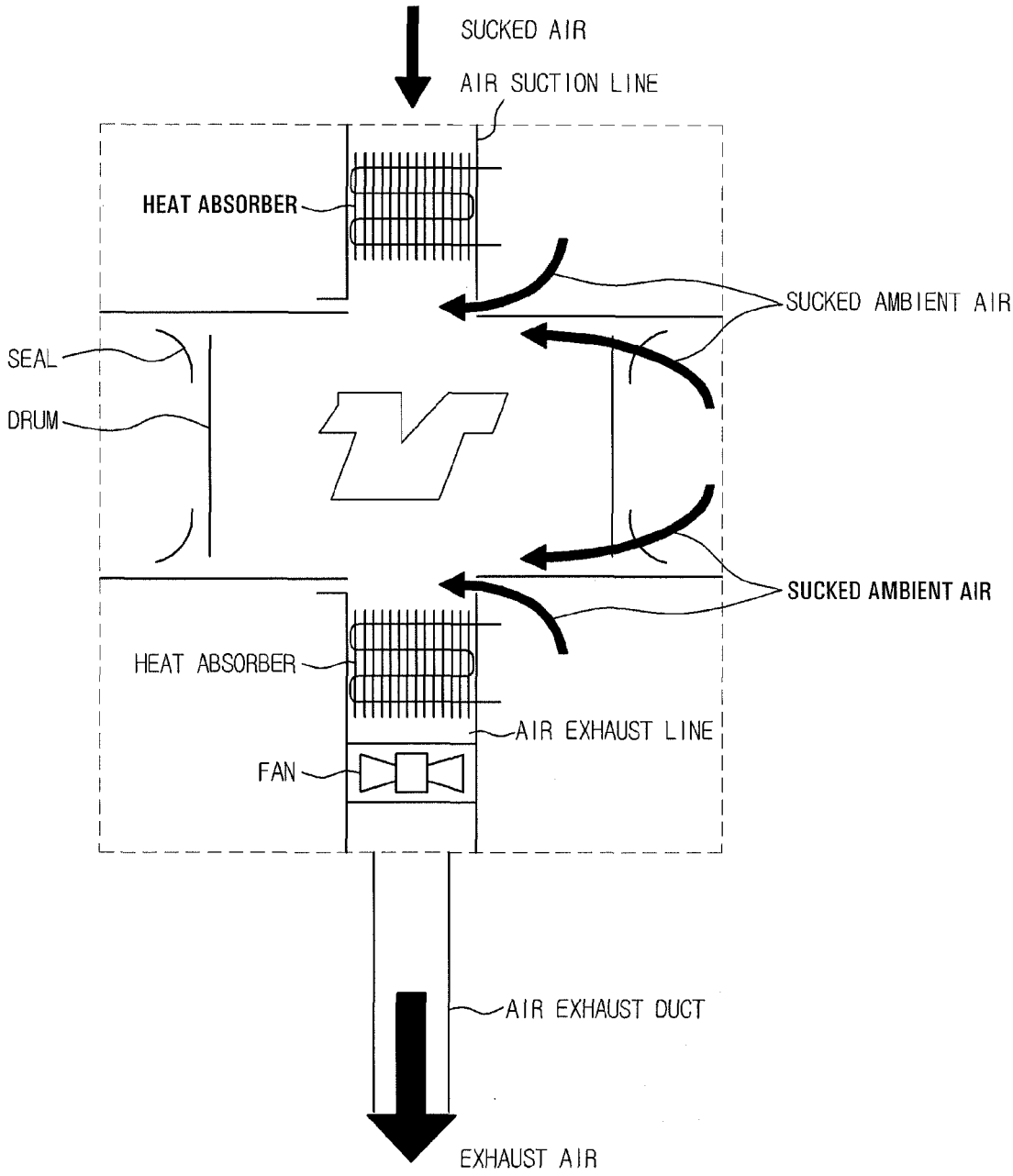
FIG. 1 is a schematic view illustrating a configuration of a conventional clothes dryer.
Figure 2:
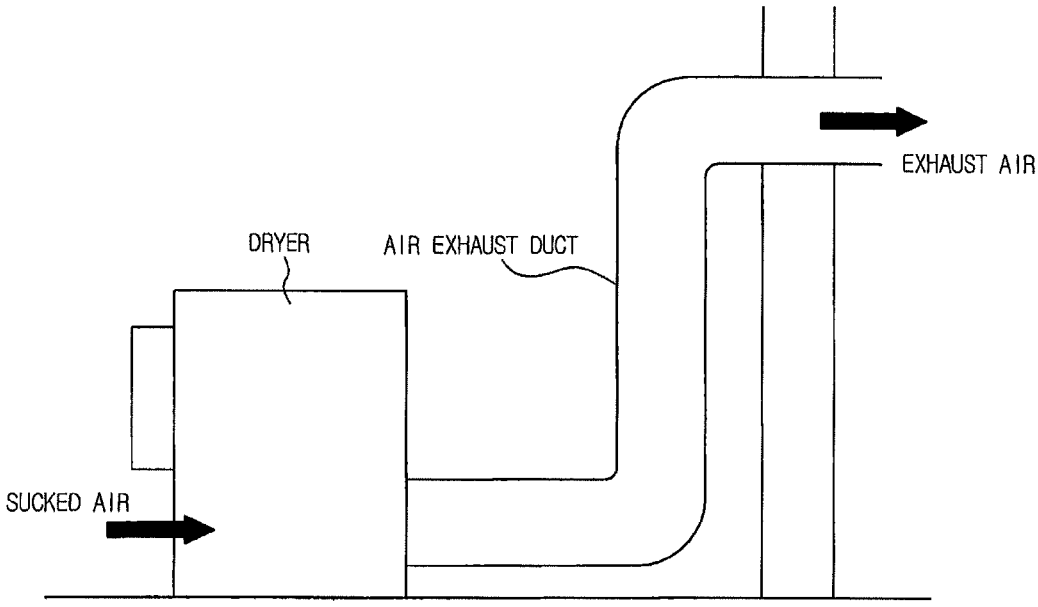
FIG. 2 is a schematic view illustrating configurations of a conventional clothes dryer and an air exhaust duct.

Reference will now be made in detail to the embodiments, examples of which are illustrated in the accompanying drawings, wherein like reference numerals refer to like elements throughout. The embodiments are described below by referring to the figures.

Figure 3:
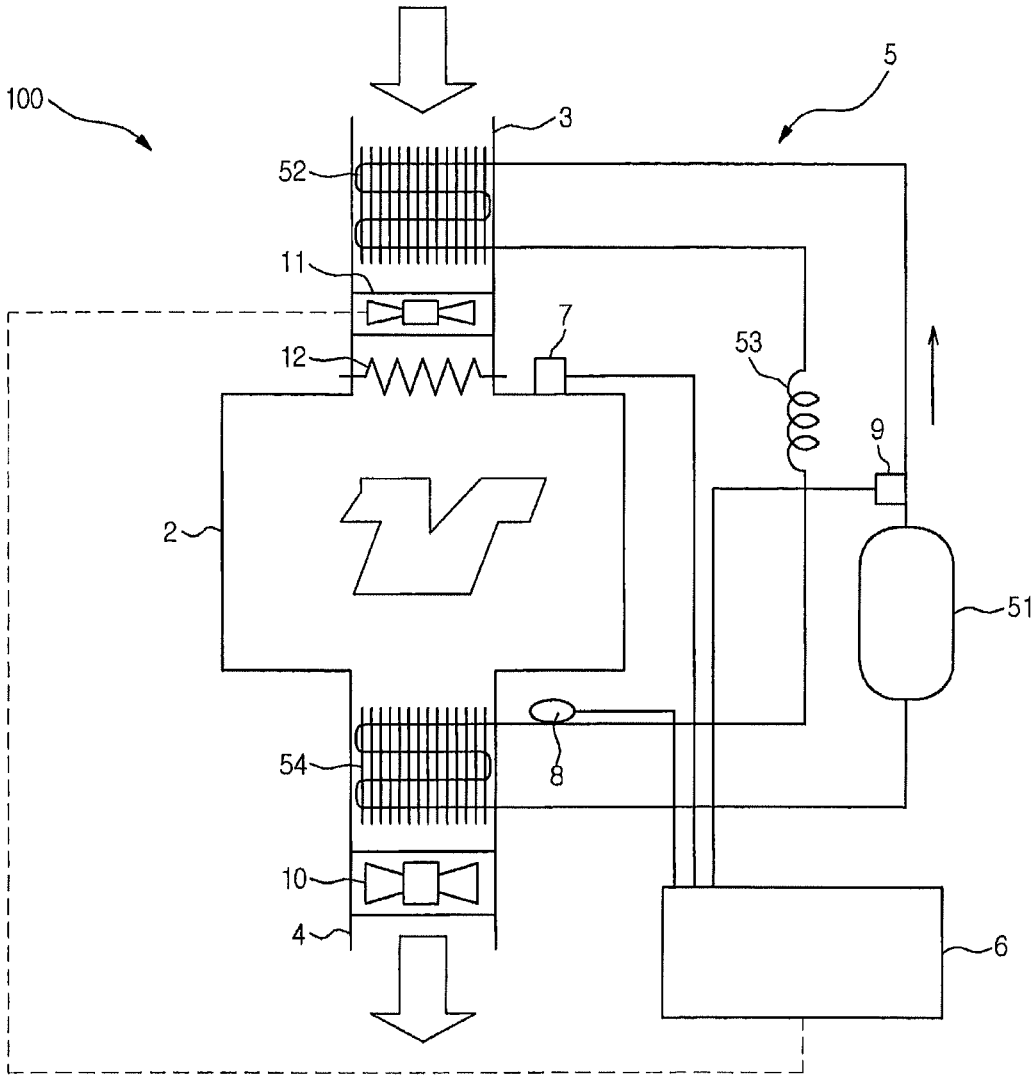
FIG. 3 is a schematic view illustrating a configuration of a clothes dryer according to an exemplary embodiment.

Referring to FIG. 3, a clothes dryer according to an exemplary embodiment is illustrated. The clothes dryer, which is designated by reference numeral 100, uses a suction/exhaust system. As shown in FIG. 3, the clothes dryer 100 includes a drum 2 to accommodate clothes, an air suction or intake line 3 to suck air into the drum 2, an air exhaust line 4 to exhaust air from the drum 2, a heat pump circuit 5, and a controller 6 to control various parts of the clothes dryer 100. A drum pressure sensor 7 is installed in the drum 2. The drum pressure sensor 7 functions as a pressure measurer to measure the internal pressure of the drum 2.

The heat pump circuit 5 includes a refrigeration cycle in which a compressor 51, a radiator 52, a pressure reducer 53, and a heat absorber 54 are connected to one another in the form of a closed loop. The heat absorber 54 is provided in the air exhaust line 4. The radiator 52 is provided in the air suction or intake line 3.

In the heat pump circuit 5, a refrigerant temperature sensor 8 is installed at an inlet of the heat absorber 54. The refrigerant temperature sensor 8 functions as a refrigerant temperature measurer to measure the temperature of refrigerant introduced into the heat absorber 54. Also, in the heat pump circuit 5, a refrigerant pressure sensor 9 is installed at a discharge pipe of the compressor 51 (an inlet of the radiator 52). The refrigerant pressure sensor 9 functions as a refrigerant pressure measurer to measure the pressure of refrigerant introduced into the radiator 52.

A first blowing mechanism 10 is provided downstream of the heat absorber 54 in the air exhaust line 4 to blow air from the inside of the drum 2 toward the outside of the drum 2. The first blowing mechanism 10 uses a centrifugal fan exhibiting high static pressure, such as a multi-blade fan or a turbo fan, taking into consideration the pressure loss of the air exhaust line.

A second blowing mechanism 11 is provided downstream of the radiator 52 in the air suction or intake line 3 to blow air from the outside of the drum 2 toward the inside of the drum 2. The second blowing mechanism 11 uses a fan exhibiting relatively low static pressure, such as an axial fan. A heater 12 is provided downstream of the second blowing mechanism 11 in the air suction or intake line 3. The second blowing mechanism 11 may be arranged upstream of the radiator 52.

The controller 6 is a so-called computer, which includes a central processing unit (CPU), a memory, an input/output (I/O) channel, an output unit such as a display, an input unit such as a keyboard, an analog/digital (ND) converter, etc. As the CPU or a peripheral device thereof operates in accordance with a control program stored in the memory, the parts of the clothes dryer 100 are controlled to perform clothes drying operation.

In detail, the controller 6 acquires a detect or pressure signal from the drum pressure sensor 7, a detect or temperature signal from the refrigerant temperature sensor 8, and a detect or pressure signal from the refrigerant pressure sensor 9, and then controls the revolutions per minute (RPM) of the second blowing mechanism 11, based on the drum pressure, refrigerant pressure, and refrigerant temperature respectively represented by the acquired signals.

Figure 4:
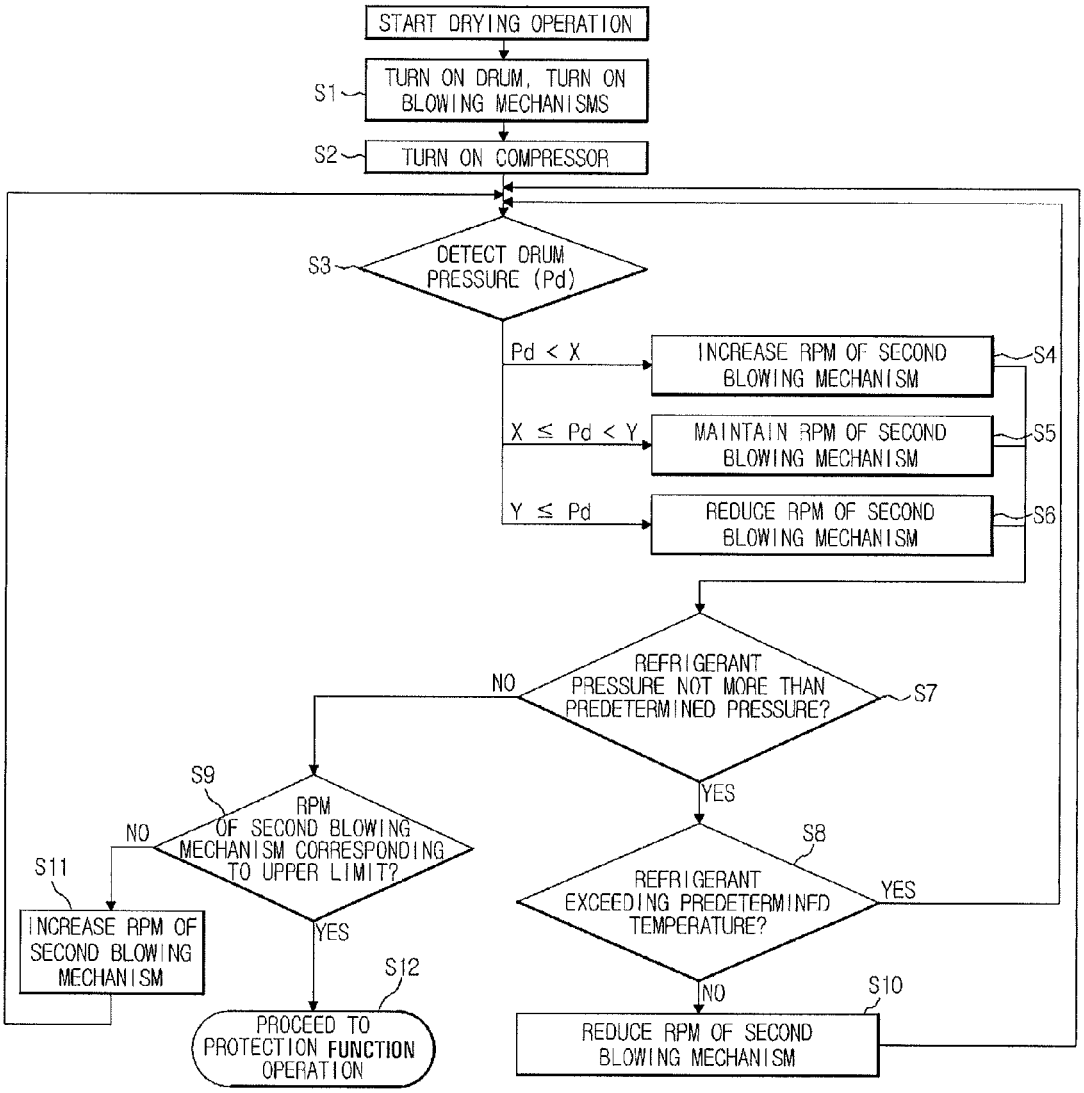
FIG. 4 is a flow chart illustrating operation of the clothes dryer according to the illustrated embodiment.

Hereinafter, a control method carried out by the controller 6 will be described with reference to FIG. 4.

First, the controller 6 acquires a drying operation start signal generated when the user presses a drying start button. In response to the drying operation start signal, the controller 6 starts a motor to rotate the drum 2, and controls the first and second blowing mechanisms 10 and 11 to rotate at predetermined initial RPMs, respectively (S1). Thereafter, the controller 6 starts the compressor 51 of the heat pump circuit 5 (S2).

The controller 6 also acquires a detect signal from the drum pressure sensor 7 to detect a drum pressure Pd (S3). When the drum pressure Pd is less than a predetermined lower limit X (for example, −50 Pa), the controller 6 controls the second blowing mechanism 11 to increase the RPM thereof (S4). On the other hand, when the drum pressure Pd is not less than the predetermined lower limit X while being less than a predetermined upper limit Y (for example, −10 Pa), the controller 6 controls the second blowing mechanism 11 to maintain the current RPM thereof (S5). Also, when the drum pressure Pd exceeds the predetermined upper limit Y, the controller 6 controls the second blowing mechanism 11 to reduce the RPM thereof (S6). In accordance with these control operations, the internal pressure of the drum 2 is controlled within a range between the lower limit (for example, −50 Pa) and the upper limit (for example, −10 Pa). Thus, it may be possible to reduce the flow rate of air introduced through gaps formed in the flow lines.

Subsequently, the controller 6 acquires a detect signal from the refrigerant pressure sensor 9 to determine whether the pressure of refrigerant introduced into the radiator 52 is not more than a predetermined pressure (for example, 3 MPa) (S7). When it is determined that the refrigerant pressure is not more than the predetermined pressure, the controller 6 acquires a detect signal from the refrigerant temperature sensor 8 to determine whether the temperature of refrigerant introduced into the heat absorber 54 is not less than a predetermined temperature (for example, 0° C.) (S8). On the other hand, when it is determined that the refrigerant pressure exceeds the predetermined pressure, the controller 6 determines whether the RPM of the second blowing mechanism 11 corresponds to the upper limit (S9).

When it is determined at operation S8 that the refrigerant temperature is not less than the predetermined temperature, the controller 6 returns to operation S3 to acquire the detect signal from the drum pressure sensor 7, and thus to detect the drum pressure Pd. On the other hand, when the refrigerant temperature is less than the predetermined temperature, the controller 6 controls the second blowing mechanism 11 to reduce the RPM thereof (S10). Thereafter, the controller 6 returns to operation S3 to acquire the detect signal from the drum pressure sensor 7, and thus to acquire the drum pressure Pd. In accordance with the control operation of the controller 6, it may be possible to increase the amount of radiated heat, and thus to reduce the temperature of the heat pump circuit 5. In this case, the refrigerant temperature of the heat absorber 54 is reduced. As a result, it may be possible to prevent the heat absorber 54 from being frosted (frozen) due to a reduction in the refrigerant temperature of the heat absorber 54.

When it is determined at operation S9 that the RPM of the second blowing mechanism 11 does not correspond to the upper limit, the controller 6 controls the second blowing mechanism 11 to increase the RPM thereof (S11). Thereafter, the controller 6 returns to operation S3 to acquire the detect signal from the drum pressure sensor 7, and thus to detect the drum pressure Pd. On the other hand, when it is determined that the RPM of the second blowing mechanism 11 corresponds to the upper limit, the controller 6 proceeds to a protection function operation (S12). In the protection function operation, the controller 67 controls the heater 12 to stop, while controlling the compressor 51 to reduce the capacity thereof or to stop.

Figure 5:
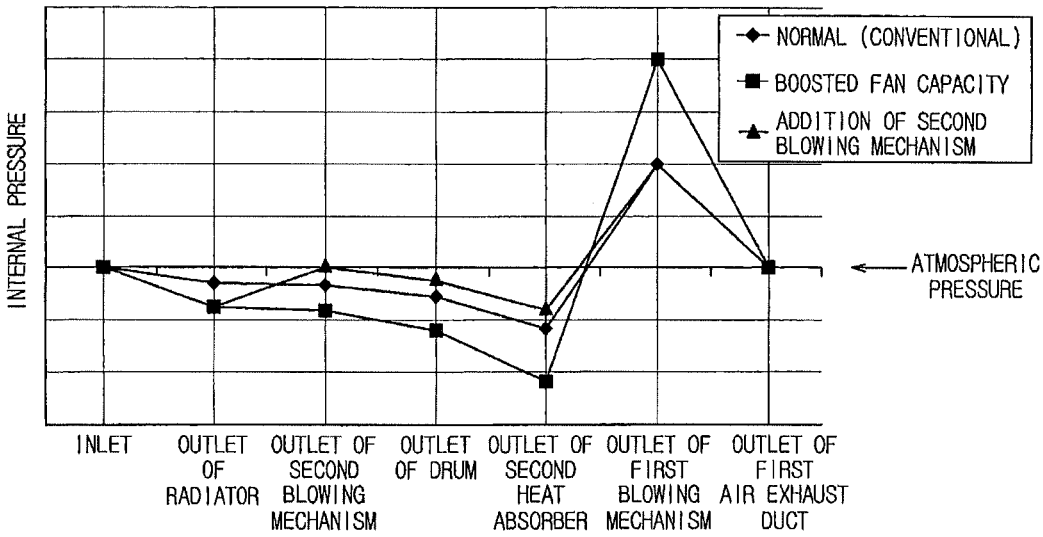
FIG. 5 shows graphs respectively depicting a variation in internal pressure in the conventional clothes dryer and a variation in internal pressure in the clothes dryer according to the illustrated embodiment.

FIG. 5 depicts the internal pressures of various parts in the conventional clothes dryer and the internal pressures of various parts in the clothes dryer according to the illustrated embodiment. The conventional clothes dryer has a configuration in which a fan is installed only in an air exhaust line. FIG. 5 shows the case in which the fan operates in a normal mode and the case in which the fan operates in a boosted mode. Referring to FIG. 5, it may be seen that, although the pressure loss of the radiator is increased in the clothes dryer of the illustrated embodiment, this pressure loss is compensated for by the second blowing mechanism. It may also be seen that the internal pressure of the drum is increased in the clothes dryer of the illustrated embodiment. Since the increase in the flow rate of air blown by the first blowing mechanism is also slight, there is no increased pressure loss in the exhaust duct, unlike the case in which the conventional fan operates in a boosted mode.

In the clothes dryer 100 according to the illustrated embodiment having the above-described configuration, the second blowing mechanism 11 is provided in the air suction or intake line 3 to compensate for the pressure loss of the radiator 52. Accordingly, it may be possible to increase the flow rate of air passing around or through the radiator 52 without increasing the air blowing rate of the first blowing mechanism 11. In accordance with the provision of the second blowing mechanism 11, it may be possible to increase the internal pressure of the drum 2, as compared to the case in which only the first blowing mechanism 10 is provided. Accordingly, the amount of air introduced through gaps of the air flow lines is reduced, so that it may be possible to suppress an increase in the flow rate of exhaust air. As a result, it may be possible not only to avoid degradation in drying capacity, but also to avoid an increase in the power consumption or noise of the fan.

The present disclosure is not limited to the above-described embodiment. For example, in place of the refrigerant pressure sensor 9 according to the illustrated embodiment, a temperature measurer may be provided to detect the temperature of refrigerant at an intermediate portion or outlet of the radiator 52, in order to perform a control operation using the detected refrigerant temperature.

Also, in place of the refrigerant temperature sensor 8, an air temperature sensor may be provided to detect the temperature of air at the downstream side of the heat absorber 54 of the air exhaust line 4, in order to perform a control operation using the detected air temperature.

In addition, it may be possible to detect filter choking of the drum 2 without using the drum pressure sensor 7. Choking detection may be achieved using, for example, a choking detection method carried out based on a continuous operation time of the drum after filter cleaning or a choking detection method carried out based on a flow rate of exhaust air detected by an air flow meter or an air flow velocity sensor.

As apparent from the above description, the clothes dryer of the present disclosure may be capable of compensating for pressure loss caused by a radiator to increase the flow rate of air passing around the radiator, suppressing introduction of ambient air through gaps formed in air flow lines to avoid degradation in drying capacity, while avoiding an increase in the power consumption or noise of a fan.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A clothes dryer, comprising:

a drum to accommodate clothes;

an air suction line to suck air into the drum;

an air exhaust line to exhaust air from the drum;

a heat pump circuit including a compressor, a radiator, a pressure reducer, and a heat absorber, wherein the heat absorber is provided in the air exhaust line, and the radiator is provided in the air suction line;

a first blowing mechanism provided in the air exhaust line;

a second blowing mechanism provided in the air suction line;

a heater arranged downstream of the radiator in the air suction line; and a controller to control the first and second blowing mechanisms, wherein the controller controls an air blowing rate of the second blowing mechanism, based on an internal pressure of the drum, a refrigerant temperature of the heat absorber, and a refrigerant pressure of the radiator, and wherein the controller stops the heater when the radiator has a refrigerant pressure not less than a predetermined pressure causing the second blowing mechanism to have a maximum air blowing rate.

2. The clothes dryer according to claim 1, further comprising:

a refrigerant temperature measurer to measure a refrigerant temperature of the heat absorber, wherein the controller acquires a measurement signal from the refrigerant temperature measurer, and reduces the air blowing rate of the second blowing mechanism when the refrigerant temperature of the heat absorber is not more than a predetermined temperature.

3. The clothes dryer according to claim 1, further comprising:

a refrigerant pressure measurer to measure a refrigerant pressure of the radiator, wherein the controller acquires a measurement signal from the refrigerant pressure measurer, and maintains or increases the air blowing rate of the second blowing mechanism when the refrigerant pressure of the radiator is not less than a predetermined pressure.

4. The clothes dryer according to claim 1, further comprising:

a drum pressure measurer to measure an internal pressure of the drum, wherein the controller controls the second blowing mechanism such that the internal pressure of the drum is not more than a predetermined pressure.

5. The clothes dryer according to claim 4, wherein the controller controls the second blowing mechanism such that the internal pressure of the drum is not less than a predetermined lower pressure and not more than a predetermined upper pressure.

6. The clothes dryer according to claim 1, wherein the first blowing mechanism comprises a multi-blade fan or a turbo fan.

7. The clothes dryer according to claim 1, wherein the second blowing mechanism comprises an axial fan.

8. A method for controlling a clothes dryer including a drum to accommodate clothes, an air suction line to suck air into the drum, an air exhaust line to exhaust air from the drum, a heat pump circuit including a compressor, a radiator, a pressure reducer, and a heat absorber, the heat absorber being provided in the air exhaust line, the radiator being provided in the air suction line, a first blowing mechanism provided in the air exhaust line, a second blowing mechanism provided in the air suction line, and a heater arranged downstream of the radiator in the air suction line, the method comprising:

controlling an air blowing rate of the second blowing mechanism, based on an internal pressure of the drum, a refrigerant temperature of the heat absorber, and a refrigerant pressure of the radiator; and stopping the heater when the radiator has a refrigerant pressure not less than a predetermined pressure causing the second blowing mechanism to have a maximum air blowing rate.

9. A method for controlling the internal conditions of a drum in a clothes dryer, the method comprising:

exhausting air from the drum with a first blowing mechanism, providing air to the drum with a second blowing mechanism, recovering heat from the exhausted air to warm the provided air to the drum with a heat pump circuit, controlling an air blowing rate of the second blowing mechanism based on an internal pressure of the drum, a refrigerant temperature of a heat absorber of the heat pump circuit, and a refrigerant pressure of a radiator of the heat pump circuit, and stopping a heater of the drum when the refrigerant pressure of the radiator is not less than a predetermined pressure causing the second blowing mechanism to have a maximum air blowing rate.

* * * * *